US008704438B2

(12) United States Patent
Cohen et al.

(10) Patent No.: US 8,704,438 B2
(45) Date of Patent: Apr. 22, 2014

(54) LAMP WITH PHOSPHOR COMPOSITION FOR IMPROVED LUMEN PERFORMANCE, AND METHOD FOR MAKING SAME

(75) Inventors: William Erwin Cohen, Solon, OH (US); William Winder Beers, Chesterland, OH (US); Fangming Du, Northfield, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/287,252

(22) Filed: Nov. 2, 2011

(65) Prior Publication Data

US 2012/0286645 A1 Nov. 15, 2012

Related U.S. Application Data

(60) Provisional application No. 61/485,720, filed on May 13, 2011.

(51) Int. Cl.

| | |
|---|---|
| ***H01J 61/14*** | (2006.01) |
| ***H01J 9/22*** | (2006.01) |
| ***H01J 1/63*** | (2006.01) |

(52) U.S. Cl.

USPC ..... 313/487; 313/486; 445/26

(58) Field of Classification Search

None

See application file for complete search history.

(56) References Cited

U.S. PATENT DOCUMENTS

| | | | | |
|---|---|---|---|---|
| 3,707,642 | A | 12/1972 | Thornton, Jr. | |
| 5,045,752 | A * | 9/1991 | Jansma | 313/487 |
| 5,644,193 | A | 7/1997 | Matsuda et al. | |
| 7,119,488 | B2 * | 10/2006 | Soules et al. | 313/587 |
| 2003/0015956 | A1 * | 1/2003 | Lisitsyn et al. | 313/489 |
| 2004/0061428 | A1 | 4/2004 | Sigai | |
| 2007/0215837 | A1 | 9/2007 | Chiruvolu | |
| 2009/0146545 | A1 * | 6/2009 | Sigai et al. | 313/486 |
| 2011/0025187 | A1 * | 2/2011 | Tews et al. | 313/487 |

FOREIGN PATENT DOCUMENTS

| | | | |
|---|---|---|---|
| JP | 2008-059943 | * | 3/2008 |
| JP | 2008059943 | A | 3/2008 |
| WO | 0012649 | A1 | 3/2000 |
| WO | 2006046213 | A1 | 5/2006 |
| WO | 2008112710 | A1 | 9/2008 |
| WO | 2010126869 | A1 | 11/2010 |

OTHER PUBLICATIONS

PCT Search Report and Written Opinion dated Sep. 3, 2012 from corresponding Application No. PCT/US2012/037467.

* cited by examiner

*Primary Examiner* — Ashok Patel

(74) *Attorney, Agent, or Firm* — Peter T. DiMauro; GE Global Patent Operation

(57) ABSTRACT

Disclosed herein are lamps comprising a radiation source and a phosphor blend configured for conversion of radiation, the phosphor blend including at least two different rare earth phosphors, wherein the phosphor blend comprises at least one multimodal rare earth phosphor. Disclosed advantages may include greater lumen output than an identical lamp in which the phosphor blend, at the same loading, does not comprise at least one multimodal rare earth phosphor.

18 Claims, 1 Drawing Sheet

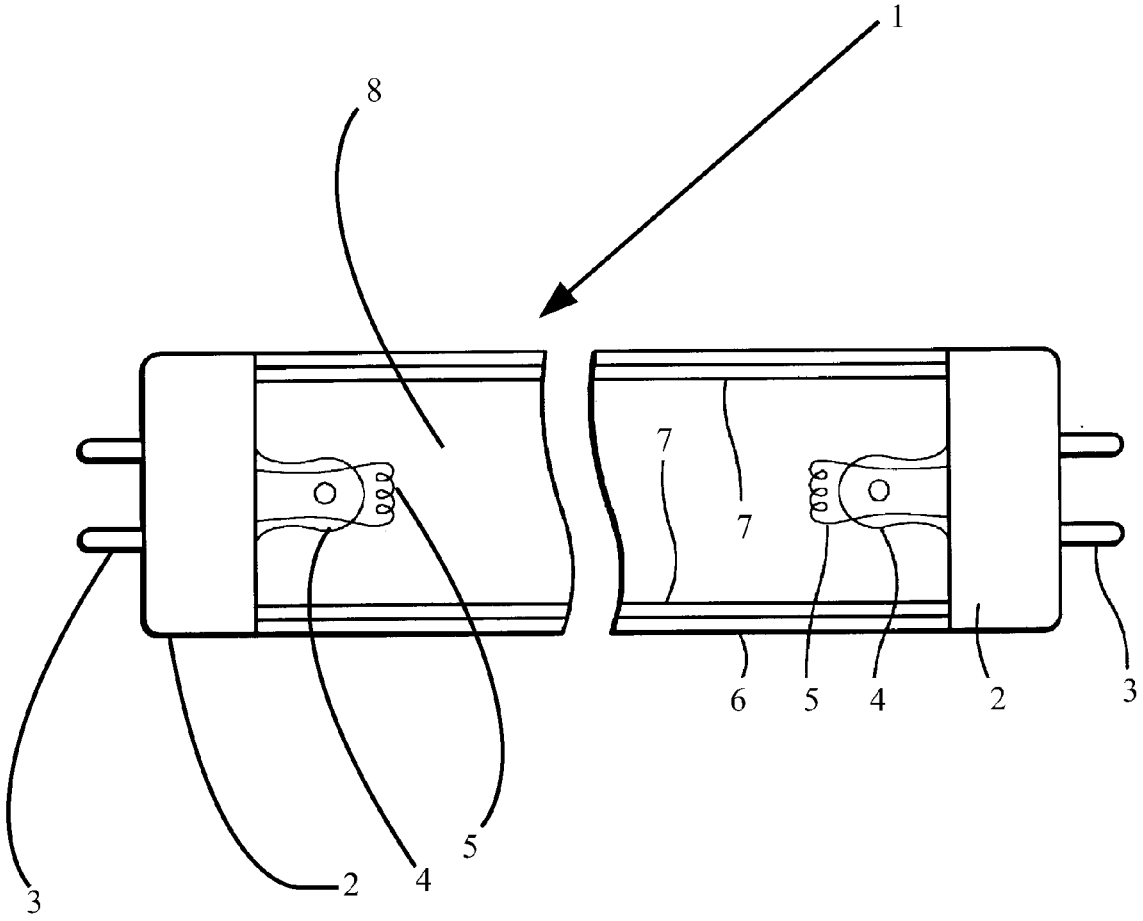
1
8
7
7
6
5
4
2
3
3
2
4
5

LAMP WITH PHOSPHOR COMPOSITION FOR IMPROVED LUMEN PERFORMANCE, AND METHOD FOR MAKING SAME

CROSS REFERENCE TO RELATED APPLICATIONS

This application is a non-provisional utility application claiming priority under 35 U.S.C. 119(e) of prior-filed copending provisional application Ser. No. 61/485,720, filed 13 May 2011, which is hereby incorporated by reference in its entirety.

FIELD OF THE INVENTION

The present invention generally relates to lamps which employ phosphors for radiation conversion, and more particular, relates to lamps having phosphor particles of specified size distribution capable of achieving improved lumen performance.

BACKGROUND

Some lamps having good energy efficiency, such as low pressure discharge lamps (e.g., fluorescent lamps) are generally known. In such lamps, a phosphor layer is employed to convert UV radiation to visible light. For good color properties of the visible light, one or more rare earth-activated phosphors are commonly employed in the layer. However, recent trends have increased the cost of rare earth-activated phosphors. This has given rise to a need to improve the lumen performance of fluorescent lamps with respect to the amount of phosphor coating used in the lamp.

In some known fluorescent lamps, relatively coarse rare earth phosphor particle systems have been used to achieve higher lumens. However, in so doing, the use of more phosphor (i.e., high coating weights) is required to achieve a thick enough layer of phosphor coating to absorb all the available ultraviolet light energy.

Therefore, in consideration of a cost increase in rare earth materials such as europium-activated yttrium oxide red phosphor, cerium- and terbium-activated green phosphor, europium-activated blue phosphors, and other phosphors that use rare earths, there is a need to avoid high coating weights in lamps.

BRIEF SUMMARY

One embodiment of the present invention is directed to a lamp comprising a radiation source capable of emitting electromagnetic radiation of a first wavelength, and a phosphor blend configured to be coupled with the radiation source for conversion of the electromagnetic radiation to a second wavelength. The phosphor blend includes at least two different rare earth phosphors, wherein the phosphor blend comprises at least one multimodal rare earth phosphor.

A further embodiment of the present invention is directed to a low-pressure discharge lamp, comprising: at least one light-transmissive envelope; a fill gas composition capable of sustaining an electric discharge sealed inside the at least one light-transmissive envelope; a phosphor blend; and optionally one or more electrical leads at least partially disposed within the at least one light-transmissive envelope for providing current. The phosphor blend includes at least two different rare earth phosphors, wherein the phosphor blend comprises at least one multimodal rare earth phosphor.

Other features and advantages of this invention will be better appreciated from the following detailed description.

BRIEF DESCRIPTION OF THE DRAWINGS

Embodiments of the invention will now be described in greater detail with reference to the accompanying FIGURE.

FIG. 1 shows diagrammatically, and partially in section, a fluorescent lamp according to embodiments of the present disclosure.

DETAILED DESCRIPTION

In accordance with embodiments of the invention, lamps are provided which use a phosphor blend containing multiple phosphors, where one or more of the phosphors are comprised of two or more separate particle size distributions of phosphor particles (e.g., coarse and fine particles). This may result in a more optimum amount of lumens with respect to the amount of phosphor coating used.

As noted, embodiments of the present invention relate to a lamp which comprises a radiation source capable of emitting electromagnetic radiation of a first wavelength, and a phosphor blend configured to be coupled with the radiation source for conversion of the electromagnetic radiation to a second wavelength. The phosphor blend includes at least two different rare earth phosphors, at least one of these being a multimodal rare earth phosphor. Typically the first wavelength may be in a blue or UV region of the electromagnetic spectrum. Typically, the second wavelength may be in the visible region of the electromagnetic spectrum and is longer than the first wavelength.

As generally known, a "phosphor" is a luminescent material that absorbs radiation energy in a portion of the electromagnetic spectrum and emits energy in another portion of the electromagnetic spectrum. One important class of phosphors are crystalline inorganic compounds of high chemical purity and of controlled composition to which small quantities of other elements (called "activators") have been added to convert them into efficient fluorescent materials. Phosphors have been used in low pressure (e.g., mercury vapor) discharge lamps to convert ultraviolet ("UV") radiation emitted by the excited mercury vapor to visible light.

A "multimodal rare earth phosphor" is a phosphor activated by at least one rare earth element, which comprises particles having a multimodal particle size distribution. In some embodiments, the blend may comprise at least three (e.g., 3, 4, 5, 6) different rare earth phosphors, with at least one of these rare earth phosphors being multimodal according to embodiments herein. In some embodiments, the blend may comprise no more than two, preferably only one, multimodal rare earth phosphor. In some embodiments, all of the different rare earth phosphors may emit light of different colors (e.g., red, green, and blue); or alternatively, there may be two or more rare earth phosphors in the blend which emit light of the same or similar color (e.g., two reds), optionally with phosphors of different color (e.g., a green and a blue). In some embodiments, the blend may further include at least one non-rare earth phosphor, such as a halophosphor (e.g., non-rare-earth activated metal halophosphate). For certain applications (e.g., CFL lamps at relatively low color temperature), there may be one rare earth phosphor (e.g., red) and one different colored rare earth phosphor (e.g., green), with at least one of these characterized as being multimodal.

As used herein, a "multimodal" particle size distribution is intended to embrace a bimodal particle size, as well as trimodal or other polymodal particle size distribution. A multimodal (e.g., bimodal) particle size distribution may be ascertainable by standard methods of analysis, well known to the person having ordinary skill in the field. Alternatively, a multimodal particle size distribution may also refer to a mixture of particles which have been formulated to have more than one mode. For example, combining a powder having a single mode with another powder of the same phosphor type but having a different single mode, may result in a bimodal particle size distribution (PSD), even if the maxima of the PSD of the combined powders are difficult to resolve analytically.

In certain embodiments, the multimodal rare earth phosphor of the blend may comprise rare earth phosphor particles having a bimodal particle size distribution. Thus, the at least one multimodal rare earth phosphor of the blend may comprise a first population of relatively coarse particles and a second population of relatively fine particles. Generally, the first population (of relatively coarse particles) may comprise from about 20 wt % to about 80 wt % (more narrowly, from about 33 wt % to about 67 wt %) of the at least one multimodal rare earth phosphor; and the second population (of relatively fine particles) may comprise from about 80 wt % to about 20 wt % (more narrowly, from about 67 wt % to about 33 wt %) of the at least one multimodal rare earth phosphor.

In accordance with embodiments of the invention, where the blend comprises rare earth phosphor particles having a bimodal particle size distribution, the bimodal particle size distribution may have a first maximum corresponding to relatively coarse particles with $d_{50}$ of less than or equal to about 10 μm (e.g, from about 5 μm to about 10 μm), and may have a second maximum corresponding to relatively fine particles with $d_{50}$ of greater than or equal to about 1 μm (e.g., from about 1 μm to about 6 μm). In some narrower embodiments, the relatively coarse particles in a bimodal particle size distribution may have $d_{50}$ of less than or equal to about 8 μm (e.g., from about 5 μm to about 8 μm), and the relatively fine particles have $d_{50}$ of greater than or equal to about 2 μm (e.g., from about 2 μm to about 6 μm). In general, the at least one multimodal rare earth phosphor in the blend may comprise particles with an overall mean size in the range of from about 2 to about 10 μm.

Without being limited by theory, it is believed that the at least one multimodal rare earth phosphor comprises a plurality of particles in which at least some relatively fine particles are dimensioned to fit in interstices between at least some relatively coarse particles. By virtue of this, a phosphor layer composed of such blend may be more efficient in absorption of the radiation (e.g., ultraviolet light). Lamps in accordance with embodiments of this disclosure may enable the opportunity to use rare earth phosphors more efficiently, thus at lower cost. It is believed that this effect may be due to more efficient packing of the phosphor particles due to the variety of particles sizes present in the coating.

In accordance with embodiments of the disclosure, the phosphor blend may include a red-emitting rare earth phosphor. Such red-emitting rare earth phosphor may be a multimodal rare earth phosphor, although the invention is not so limited.

A red-emitting rare earth phosphor may comprise one or more of: a europium-doped yttrium oxide (e.g., YEO); a europium-doped yttrium vanadate-phosphate (e.g., $Y(P,V)O_4$:Eu); a manganese- and cerium-coactivated metal pentaborate (e.g., CBM); or the like. Other possible red rare earth phosphors may include Eu-activated yttrium oxysulfide, or europium(III)-doped gadolinium oxides and borates, such as $(Y,Gd)_2O_3:Eu^{3+}$ and $(Y,Gd)BO_3:Eu^{3+}$. A possible formula for the europium-doped yttrium oxide phosphor may be generally $(Y_{(1-x)}Eu_x)_2O_3$, where $0<x<0.1$, possibly, $0.02<x<0.07$, for example, $x=0.06$. Such europium-doped yttrium oxide phosphors are often abbreviated YEO (or sometimes YOX or YOE). A possible manganese- and cerium-coactivated metal pentaborate can have formula $(Gd(Zn,Mg)B_5O_{10}:Ce^{3+},Mn^{2+}$ (CBM).

In accordance with embodiments of the disclosure, the phosphor blend may include a green-emitting rare earth phosphor. Such green-emitting rare earth phosphor may be a multimodal rare earth phosphor, although the invention is not so limited. A green-emitting rare earth phosphor may comprise one or more of a cerium- and terbium-coactivated lanthanum phosphate (e.g., LAP), cerium- and terbium-coactivated magnesium aluminate (e.g., CAT); or a europium- and manganese-coactivated barium magnesium aluminate (e.g., BAMn); or cerium- and terbium-coactivated gadolinium magnesium pentaborate (e.g, CBT, $GbMgB_5O_{10}:Ce^{3+},Tb^{3+}$); or the like. Typical formulae for cerium- and terbium-doped lanthanum phosphate may include one selected from: $LaPO_4$:Ce,Tb; $LaPO_4:Ce^{3+}$, $Tb^{3+}$; or $(La,Ce,Tb)PO_4$. Specific cerium- and terbium-doped lanthanum phosphate phosphors in accordance with embodiments of the invention may have the formula $(La_{(1-x-y)}Ce_xTb_y)PO_4$, where $0.1<x<0.6$ and $0<y<0.25$ (or possibly, $0.2<x<0.4$; $0.1<y<0.2$) (LAP). Other cerium- and terbium-doped phosphor may be (Ce,Tb)$MgAl_{11}O_{19}$ (CAT); and $(Ce,Tb)(Mg,Mn)Al_{11}O_{19}$. It is possible for BAMn to be considered as a green rare-earth phosphor, depending on the molar ratio among its activators.

In accordance with embodiments of the disclosure, the phosphor blend may include a blue-emitting rare earth phosphor. Such blue-emitting rare earth phosphor may be a multimodal rare earth phosphor. A blue-emitting rare earth phosphor may comprise one or more of: a europium-doped halophosphate (e.g., SECA, with typical formula $(Sr, Ca, Ba)_5(PO_4)_3Cl:Eu^{2+}$), a europium-doped barium magnesium aluminate (e.g., BAM), a europium- and manganese-coactivated magnesium aluminate (e.g., BAMn), a europium-doped strontium aluminate (e.g., SAE), a europium-doped borophosphate, a cerium-doped yttrium aluminate (e.g., YAG); or the like. A europium-doped strontium aluminate may have the formula of $Sr_4Al_{14}O_{25}:Eu^{2+}$ (SAE). In such formula, the europium-doped strontium aluminate phosphor may comprise Sr and Eu in the following atom ratio: $Sr_{0.90-0.99}Eu_{0.01-0.1}$. BAM may have the formula $(Ba,Sr,Ca)MgAl_{10}O_{17}:Eu^{2+}$. BAMn may have the formula $(Ba,Sr,Ca)MgAl_{10}O_{17}:Eu^{2+},Mn^{2+}$. It is possible for a europium- and manganese-coactivated barium magnesium aluminate (e.g., BAMn), to be sometimes considered as a blue-green, blue, or green rare-earth phosphor, often depending on the molar ratio among its activators.

As already noted, phosphor blends in accordance with embodiments of the invention may optionally further comprise a non-rare-earth-activated phosphor, such as a halophosphor. As used herein, the term "halophosphor" is intended to refer to a phosphor which includes at least one halogen component (preferably chlorine or fluorine, or a mixture thereof) but which is not activated by a rare earth element. A halophosphor may emit a color upon excitation, or may emit light which is perceived to be white. An example of a blue or blue-green emitting halophosphor may include a calcium halophosphate (e.g, fluorophosphate) activated with antimony (3+). An example of a white-emitting halophosphor may include a calcium fluoro-, chloro phosphate activated with antimony (3+) and manganese (2+), such as $Ca_{5-x-y}(PO_4)_3F_{1-z-y}Cl_zO_y:Mn_xSb_y$. Other non-rare-earth-activated phosphors may include one or more of strontium red (e.g., $(Sr,Mg)_3(PO_4)_2$:Sn) or strontium blue (e.g., $Sr_{10}(PO_4)_6F_2$:Sb,Mn).

When reciting the chemical formulae for phosphors, the element(s) following the colon represents activator(s). If two or more elements are present after the colon, they are generally both present as activators. As used herein throughout this disclosure, the term "doped" is equivalent to the term "activated". The various phosphors of any color described herein can have different elements enclosed in parentheses and separated by commas, such as in $(Ba,Sr,Ca)MgAl_{10}O_{17}:Eu^{2+}$, $Mn^{2+}$ phosphor. As would be understood by anyone skilled in the art, the notation (A,B,C) signifies $(A_xB_yC_z)$ where $0 \le x \le 1$ and $0 \le y \le 1$ and $0 \le z \le 1$ and $x+y+z=1$. For example, (Sr,Ca,Ba) signifies $(Sr_xCa_yBa_z)$ where $0 \le x \le 1$ and $0 \le y \le 1$ and $0 \le z \le 1$ and $x+y+z=1$. Typically, but not always, x, y, and z are all nonzero. The notation (A,B) signifies $(A_xB_y)$ where $0 \le x \le 1$ and $0 \le y \le 1$ and $x+y=1$. Typically, but not always, x and y are both nonzero.

A blue phosphor may have a peak emission of about 440 to 500 nm; a green phosphor may have a peak emission of about 500 to 600 nm; and a red phosphor may have a peak emission of about 610 to 670 nm (for certain red phosphors, there may be one or more peak as low as 590 nm).

In accordance with embodiments of the present invention, lamps include one or more radiation source which may comprise one or more of a discharge-based radiation source or a solid-state radiation source. A discharge-based radiation source may include a low-pressure vapor discharge source, such as is employed in a fluorescent lamp system. The radiation source may also comprise a solid-state radiation source such as OLED or LED. For example, certain solid state radiation sources (e.g., LED) or OLED) may emit electromagnetic radiation which can be converted with a phosphor blend to useful light of a different wavelength, e.g., visible light. To produce visible (e.g., white) light using a blue or UV solid state radiation source (e.g., LED die), one may deposit a phosphor blend directly over the solid state radiation source. One may also couple a preformed tile of phosphor blend on the top of an LED die. It is also within the present disclosure to combine a phosphor powder blend in an encapsulant or binder material (e.g., silicone or epoxy), and mold the mixture over a solid state radiation source (e.g., LED die) to form a lens. The blend may also be in a remote phosphor configuration relative to the solid state radiation source.

In many embodiments of the present invention, the lamp may be a low-pressure discharge lamp (e.g., fluorescent). Such lamp typically comprises at least one light-transmissive envelope (which can be made of a vitreous (e.g., glass) material and/or ceramic, or any suitable material which allows for the transmission of at least some visible light); a fill gas composition (i.e., one which is capable of sustaining an electric discharge) sealed inside the at least one light-transmissive envelope; the present inventive phosphor blend; and optionally one or more electrical leads at least partially disposed within the at least one light-transmissive envelope for providing electric current. Alternatively such lamp may be electrodeless.

A low-pressure discharge lamp may generally be constructed by any effective method, including many known or conventional methods. Some non-limiting examples of materials which may comprise the discharge fill of lamps include at least one material selected from the group consisting of Hg, Na, Zn, Mn, Ni, Cu, Al, Ga, In, Tl, Sn, Pb, Bi, Ti, V, Cr, Zr, Nb, Mo, Hf, Ta, W, Re, Os, Ne, Ar, He, Kr, Xe and combinations and compounds thereof; or the like. In one embodiment, the discharge fill material in a lamp includes mercury. In another embodiment, the discharge fill material in a lamp is mercury free. In particular, where a substantially mercury-free discharge fill is desired, the discharge fill may comprise at least one material selected from the group consisting of a gallium halide, a zinc halide and an indium halide; or the like. The fill will be present at any effective pressure, e.g., a pressure effective to sustain a low-pressure discharge, as can be readily ascertained by any person skilled in the field. Some suitable pressures may comprise a total fill pressure of from about 0.1 to about 30 kPa; other values are possible as well.

It is contemplated to be within the scope of the disclosure to make and use the lamps disclosed herein, in a wide variety of types, including mercury fluorescent lamps, low dose mercury, very high output fluorescent, and mercury free low-pressure fluorescent lamps. The lamp may include electrodes or may be electrodeless. The lamp may be linear, but any size shape or cross section may be used. It may be any of the different types of fluorescent lamps, such as T5, T8, T12, 17 W, 20 W, 25 W, 32 W, 49 W, 54 W, 56 W, 59 W, 70 W, linear, circular, 2D, twin tube or U-shaped fluorescent lamps. They may be high-efficiency or high-output fluorescent lamps. For example, embodiments of the present invention include lamps that are curvilinear in shape, as well as compact fluorescent lamps as are generally familiar to those having ordinary skill in the art. Compact fluorescent lamps (CFL's) having a folded or wrapped topology so that the overall length of the lamp is much shorter than the unfolded length of the glass tube. The varied modes of manufacture of and configurations for linear as well as compact fluorescent lamps are generally known to persons skilled in the field of low pressure discharge lamps.

Generally, a phosphor blend in accordance with embodiments of the invention, when used in low pressure discharge lamps, will have at least one phosphor composition carried on a light-transmissive envelope, e.g., on an inner surface of a light-transmissive envelope. In embodiments where the lamp has multiple envelopes, the light-transmissive envelope upon which is disposed a phosphor composition may be an inner envelope. A phosphor composition may be applied to the envelope by any effective method, including known or conventional methods, such as by slurrying. Methods of preparing and applying phosphor coating slurries are generally known or conventional in the art.

When the phosphor blend in accordance with embodiments of the invention is present as a layer disposed on an envelope of a discharge lamp, it may be present as a single layer; or present as multiple layers of same blend; or present as a layer of a multilayer coating. Typically, a barrier layer may also be disposed on an envelope of a discharge lamp.

A vapor discharge lamp in accordance with embodiments of the invention may comprise from 1 g to about 6 g of the phosphor blend. For example, for a 4 foot T8 fluorescent lamp, from about 1 g to about 4 g/bulb of phosphor blend may be employed; and for a four foot T12 fluorescent lamp, from about 1 g to about 6 g/bulb of phosphor blend may be employed. For eight foot lamps, a T8 lamp may employ from about 2 g to about 8 g, and a T12 lamp may employ from about 2 g to about 12 g. An alternative way of expressing content of phosphor blend is by mass per surface area of inner envelope. By this measure, a lamp may typically comprise from about 1 $mg/cm^2$ to about 6 $mg/cm^2$ of the phosphor blend.

Referring now to FIG. 1, herein is shown an exemplary embodiment of a one type of lamp in accordance with the disclosure, namely, a fluorescent lamp 1. Such lamp may be low- or high-pressure, and may contain mercury vapor as a fill, or may be mercury-free, but will (in this exemplary embodiment) contain a vapor that supports a discharge. The fluorescent lamp 1 has a light-transmissive tube or envelope 6 formed from glass or other suitable material, which may have a circular cross-section. An inner surface (not specifically shown) of the glass envelope 6 is provided with a phosphor-containing layer 7. A barrier may be present between the envelope 6 and the phosphor-containing layer 7. The lamp is typically hermetically sealed by bases 2, attached at ends of the tube, respectively. Usually two spaced electrodes 5 are respectively mounted on the bases 2, and can be supported by stems 4. The electrodes 5 are typically provided with current by pins 3 which are received in an electric socket. A discharge-sustaining fill 8, which may be formed from mercury and an inert gas, is sealed inside the glass tube. The inert gas is typically argon or a mixture of argon and other noble gases at low pressure, which, in combination with a small quantity of mercury, provide the low vapor pressure manner of operation.

The phosphor-containing layer 7 contains a blend of phosphor particles which comprises at least one multimodal rare earth phosphor. Individual phosphor material amounts used in the phosphor composition of the phosphor layer 7 will vary depending upon the desired color spectra and/or color temperature. The weight percent of each phosphor composing the phosphor layer 7 may vary depending on the characteristics of the desired light output.

Embodiments of the invention also include a method of making a lamp employing a phosphor blend, the blend including at least two different rare earth phosphors. Such method comprises at least a step of blending at least one multimodal rare earth phosphor, the multimodal rare earth phosphor comprising particles having a multimodal particle size distribution, with a different rare earth phosphor. Lamps may be constructed by any effective method, which may include other steps which are generally known or conventional in the field.

It is contemplated that there may also be embodiments of the invention wherein the described phosphor blend is employed as, or is part of, a scintillation system. Typically, if the described phosphor blend is employed as a scintillator, it may be provided in the form of a transparent solid body. A phosphor blend as disclosed herein may be employed as part of a gamma ray camera, a CT scanner, a laser, a CRT, a plasma display, and can be used a precursor to a scintillator.

Lamps in accordance with embodiments of the present invention may offer numerous advantages. For example, lamps may achieve a greater lumen output than an identical lamp (at equivalent phosphor blend coating weight) in which the phosphor blend does not comprise at least one multimodal rare earth phosphor. Thus, embodiments of the invention also include a method of achieving consistent lumens at lower phosphor weight (or, alternatively stated, a method for achieving higher lumens at same phosphor weight), through conversion of radiation by a phosphor blend, wherein one of the phosphors in the blend (e.g., a rare earth phosphor or a non-rare earth phosphor) has a multimodal particle size distribution. In such method, the multimodal phosphor may be a rare earth phosphor or a halophosphor.

In order to promote a further understanding of the invention, the following examples are provided. These examples are illustrative, and should not be construed to be any sort of limitation on the scope of the invention.

EXAMPLES

Example 1

A blend of phosphors was prepared in accordance with embodiments of the invention, employing the following three rare earth phosphors: blue BAM, green LAP, and red YEO. The BAM had a mono-modal particle size distribution with a $d_{50}$ of 7.73 micrometers, whereas the LAP had mono-modal particle size distribution with a $d_{50}$ of 5.27 micrometers. The YEO used was prepared in a manner to obtain a bimodal particle size distribution. It was formulated from small particle YEO (56 wt % of the total red YEO) and large particle YEO (44 wt % of the total red YEO). The relatively larger particles were commercially obtained, while the relatively smaller particles could be obtained by firing a coprecipitated yttrium/europium oxide. Particle size distributions for each of the constituent phosphors is shown in Table I (measured on a LA-950 Horiba Laser Scatter PSI) Analyzer.

TABLE I

| Rare Earth Phosphor Type | PSD $d_{10}$ (μm) | PSD $d_{50}$ (μm) | PSD $d_{90}$ (μm) |
|---|---|---|---|
| YEO (relatively smaller particle size) | 1.79 | 4.74 | 8.19 |
| YEO (relatively larger particle size) | 4.46 | 6.66 | 9.93 |
| LAP green | 3.14 | 5.27 | 8.03 |
| BAM blue | 5.05 | 7.73 | 11.72 |

The relative weight percents of constituent phosphors is shown in Table II.

TABLE II

| Rare Earth Phosphor Type | Weight percent of total rare earth phosphors |
|---|---|
| YEO (relatively smaller particle size) | 28.0 |
| YEO (relatively larger particle size) | 21.6 |
| LAP green | 41.1 |
| BAM blue | 9.3 |

To facilitate coating, the blend was combined with polymeric binder (PEO) and inorganic additive (alumina). After suspension, the inner surface of a T8 linear fluorescent lamp was coated to adhere the phosphor to the bulb. The total weight of the phosphor blend employed in this example was 1.5 g per bulb (ca. 1.5 mg/cm$^2$). After completion of the T8 lamp, the lumen output was measured by following the IES standard LM-9-09 (Electrical and Photometric Measurements of Fluorescent Lamps), in a sphere with spectrophotometric detection. The lumens per watt (LPW) by this standard, in this example, was 87.

Example 2

In this example, the same type of lamp was constructed under the same conditions as in Example 1, with the sole difference being the coating weight. In this example, the total weight of the phosphor blend employed in this example was 2.0 g per bulb (ca. 2.1 mg/cm$^2$). The lumen output was measured in the same way as in the previous Example, resulting in 88 LPW.

Comparative Example 3

Comparative lamps were constructed from the same phosphors in the same relative proportions in the same way as in Examples 1 and 2, except without the bimodal particle size distribution. A T8 lamp was made using only the relatively larger particle size YEO red. That is, the PSD for the YEO was the same as the "relatively larger particle size" of Example 1.

The weight percents in the blend were 49.6 wt %, 41.1 wt %, and 9.3 wt %, respectively of YEO, LAP and BAM. Coating this blend onto a lamp in the same way as in the Examples at 1.5 g/bulb resulted in 84 LPW, and coating at 2.0 g/bulb exhibited 86 LPW, measured in the same way as in the Examples. Thus, the values for LPW were 2-3 lumens per watt higher for the exemplary blends employing the bimodal YEO red, as compared to this comparative example.

Comparative Example 4

A comparative lamp was constructed from the same phosphors in the same relative proportions as in Examples 1 and 2, except without the bimodal particle size distribution, and using only smaller particle size YEO red. The PSD for the YEO was the same as the "relatively smaller particle size" of Example 1. The weight percents in the blend were 49.6 wt %, 41.1 wt %, and 9.3 wt %, respectively of YEO, LAP and BAM. Coating this blend onto a lamp in the same way as in the Examples at 1.5 g/bulb resulted in 83 LPW and coating at 2.0 g/bulb exhibited 86 LPW, measured in the same way as in the Examples. The values for LPW were 2-4 lumens per watt higher for the exemplary blends employing the bimodal YEO red, as compared to this comparative example.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" used in connection with a quantity is inclusive of the stated value and has the meaning dictated by the context (for example, includes the degree of error associated with the measurement of the particular quantity). "Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present. The singular forms "a", "an" and "the" include plural referents unless the context clearly dictates otherwise. All ranges disclosed herein are inclusive of the recited endpoint and independently combinable.

As used herein, the phrases "adapted to," "configured to," and the like refer to elements that are sized, arranged or manufactured to form a specified structure or to achieve a specified result. While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description. It is also anticipated that advances in science and technology will make equivalents and substitutions possible that are not now contemplated by reason of the imprecision of language and these variations should also be construed where possible to be covered.

What is claimed as new and desired to be protected by Letters Patent of the United States is:

1. A lamp, comprising:

a radiation source capable of emitting electromagnetic radiation of a first wavelength; and a phosphor blend configured to be coupled with said radiation source for conversion of said electromagnetic radiation to a second wavelength, said phosphor blend including at least two different rare earth phosphors, wherein the phosphor blend comprises at least one multimodal rare earth phosphor, wherein the at least one multimodal rare earth phosphor comprises a first population of relatively coarse particles and second population of relatively fine particles, and wherein the multimodal rare earth phosphor comprises a bimodal particle size distribution having a first maximum corresponding to relatively coarse particles with $d_{50}$ of less than or equal to about 10 microns, and a second maximum corresponding to relatively fine particles with $d_{50}$ of greater than or equal to about 1 micron.

2. The lamp in accordance with claim 1, wherein the radiation source comprises one or more of a discharge-based radiation source or a solid-state radiation source.

3. The lamp in accordance with claim 1, wherein the first population comprises from about 20 to about 80 wt % of the at least one multimodal rare earth phosphor, and the second population comprises from about 80 to about 20 wt % of the at least one multimodal rare earth phosphor.

4. The lamp in accordance with claim 1, wherein the first wavelength is in a blue or UV region of the electromagnetic spectrum, and wherein the second wavelength is in the visible region of the electromagnetic spectrum and is longer than the first wavelength.

5. The lamp in accordance with claim 1, wherein the blend comprise two or more different multimodal rare earth phosphors.

6. The lamp in accordance with claim 1, wherein the blend comprises at least three different rare earth phosphors.

7. The lamp in accordance with claim 1, wherein blend further includes at least one haltophosphor.

8. The lamp in accordance with claim 1, wherein the lamp achieves greater lumen than an identical lamp at equivalent phosphor coating weight in which the blend does not comprise at least one multimodal rare earth phosphor.

9. The lamp in accordance with claim 1, wherein the at least one multimodal rare earth phosphor comprises a plurality of particles in which at least some relatively fine particles are dimensioned to fit in interstices between at least some relatively coarse particles.

10. The lamp in accordance with claim 1, wherein the blend includes a red-emitting rare earth multimodal phosphor.

11. The lamp in accordance with claim 10, wherein said red-emitting rare earth phosphor comprises one or more of europium-doped yttrium oxide, europium-doped yttrium vanadate-phosphate, or manganese- and cerium-coactivated metal pentaborate.

12. The lamp in accordance with claim 1, wherein the blend includes a green-emitting rare earth multimodal phosphor.

13. The lamp in accordance with claim 12, wherein said green-emitting rare earth phosphor comprises one or more of a cerium- and terbium-coactivated lanthanum phosphate, europium- and manganese-coactivated barium magnesium aluminate, cerium- and terbium-coactivated gadolinium magnesium pentaborate, or cerium- and terbium-coactivated magnesium aluminate.

14. The lamp in accordance with claim 1, wherein the blend includes a blue-emitting rare earth multimodal phosphor.

15. The lamp in accordance with claim 14, wherein said blue-emitting rare earth phosphor comprises one or more of europium-doped halophosphate, a europium-doped barium magnesium aluminate, a europium- and manganese-coactivated barium magnesium aluminate, a europium-doped strontium aluminate, a europium-doped borophosphate, a cerium-doped yttrium aluminate, or SECA.

16. The lamp in accordance with claim 1, wherein the lamp comprises from 1 $mg/cm^2$ to about 6 $mg/cm^2$ of the phosphor blend.

17. A low-pressure discharge lamp, comprising:

at least one tight-transmissive envelope;

a fill gas composition capable of sustaining an electric discharge sealed inside the at least one light-transmissive envelope; and a phosphor blend;

wherein said phosphor blend including at least two different rare earth phosphors, wherein the phosphor blend comprises at least one multimodal rare earth phosphor, wherein the at least one multimodal rare earth phosphor comprises a first population of relatively coarse particles and second population of relatively fine particles, and wherein multimodal rare earth phosphor comprises a bimodal particle size distribution having a first maximum corresponding to relatively coarse particles with $d_{50}$ of less than or equal to about 10 microns, and a second maximum corresponding to relatively fine particles with $d_{50}$ of greater than or equal to about 1 micron.

18. A method comprising the step of coupling a radiation source capable of emitting electromagnetic radiation of a first wavelength with a phosphor blend to convert said electromagnetic radiation to a second wavelength;

wherein said phosphor blend including at least two different rare earth phosphors, and wherein the phosphor blend comprises at least one multimodal rare earth phosphor, wherein the at least one multimodal rare earth phosphor comprises a first population of relatively coarse particles and second population of relatively fine particles, and wherein the multimodal rare earth phosphor comprises a bimodal particle size distribution having a first maximum corresponding to relatively coarse particles with $d_{50}$ of less than or equal to about 10 microns, and a second maximum corresponding to relatively fine particles with $d_{50}$ of greater than or equal to about 1 micron;

wherein said method operates a lamp to achieve consistent lumen output at a reduced quantity of phosphor and/or said method operates a lamp to achieve higher lumen output at a constant quantity of phosphor.

* * * * *